US012467167B1

(12) United States Patent
Cortinovis

(10) Patent No.: US 12,467,167 B1
(45) Date of Patent: Nov. 11, 2025

(54) CONTAINMENT GARMENT AND RESPECTIVE MANUFACTURING METHOD

(71) Applicant: Laura Cortinovis, Collebeato (IT)

(72) Inventor: Laura Cortinovis, Collebeato (IT)

( * ) Notice: Subject to any disclaimer, the term of this patent is extended or adjusted under 35 U.S.C. 154(b) by 0 days.

(21) Appl. No.: 18/862,602

(22) PCT Filed: May 5, 2023

(86) PCT No.: PCT/IB2023/054695

§ 371 (c)(1),
(2) Date: Nov. 4, 2024

(87) PCT Pub. No.: WO2023/214370

PCT Pub. Date: Nov. 9, 2023

(30) Foreign Application Priority Data

May 6, 2022 (IT) ..... 102022000009362

(51) Int. Cl.
*D04B 1/12* (2006.01)
*A41B 11/02* (2006.01)
*D04B 1/10* (2006.01)

(52) U.S. Cl.
CPC ..... *D04B 1/12* (2013.01); *A41B 11/02* (2013.01); *D04B 1/102* (2013.01)

(58) Field of Classification Search
CPC ... D04B 1/12; D04B 1/18; D04B 1/26; D04B 1/265; D04B 7/16; D04B 1/102; D04B 9/46; D04B 9/52; A41B 11/02; A61F 13/08
See application file for complete search history.

(56) References Cited

U.S. PATENT DOCUMENTS 8,317,736 B2 * 11/2012 Virkus ..... A61F 13/08 602/61
8,533,864 B1 * 9/2013 Kostrzewski ..... A41D 13/0015 2/69
8,973,411 B2 * 3/2015 Gaither ..... A61F 13/08 2/241
2003/0230121 A1 * 12/2003 Yokoyama ..... D04B 1/26 66/178 A (Continued)

FOREIGN PATENT DOCUMENTS

WO 2019104263 A1 5/2019
WO WO-2019224846 A1 * 11/2019 ..... D04B 1/18
WO WO-2023214370 A1 * 11/2023 ..... D04B 1/18

OTHER PUBLICATIONS

International Search Report and Written Opinion From PCT/IB2023/054695, Dated Jul. 10, 2023.

*Primary Examiner* — Danny Worrell
(74) *Attorney, Agent, or Firm* — Carmel Patent Agency; Robert Ballarini

(57) ABSTRACT

A knitted containment garment to be worn at least at part of a user's joint includes at least one stretch portion, having at least at part thereof, a containment portion as well, which extends at least at the portion of the containment manufactured article to be worn on the heel, kneecap, elbow, back of the wrist or shoulder of the user, in which one or more first stitches include at least one main yarn alternate with one or more second stitches including a containment yarn, so that a floating length of the containment yarn extends at the first stitches and a floating length of the main yarn extends at the second stitches.

14 Claims, 9 Drawing Sheets

(56) References Cited

U.S. PATENT DOCUMENTS

| | | | | |
|---|---|---|---|---|
| 2009/0165190 | A1* | 7/2009 | Araki | A61F 13/064 66/178 A |
| 2009/0276939 | A1* | 11/2009 | Sho | D04B 1/26 66/178 A |
| 2011/0314591 | A1* | 12/2011 | Mitsuno | D04B 1/265 2/239 |
| 2012/0283610 | A1 | 11/2012 | Matsuo | |
| 2012/0284902 | A1 | 11/2012 | Matsuo | |
| 2014/0053610 | A1* | 2/2014 | Fukui | D04B 1/102 66/178 A |
| 2017/0035120 | A1* | 2/2017 | Ramsey | D04B 1/12 |
| 2018/0051401 | A1 | 2/2018 | Giorgini | |
| 2018/0353345 | A1* | 12/2018 | Sasaki | D04B 1/104 |
| 2021/0156058 | A1 | 5/2021 | Cortinovis | |

* cited by examiner

3

CONTAINMENT GARMENT AND RESPECTIVE MANUFACTURING METHOD

CROSS-REFERENCE TO RELATED APPLICATIONS

This application is a § 371 U.S. National Phase of International Patent Application PCT/IB2023/054695, filed May 5, 2023, which claims priority of Italian Patent Application No. 102022000009362, filed May 6, 2022, the entire contents of all of which are incorporated by reference herein as if fully set forth.

FIELD OF THE INVENTION

The present invention generally relates to the field of knitwear and particularly relates to containment garments, especially for sports, to be worn at a user's joint. The invention further relates to a method of manufacturing such garments by circular machines for knitwear and hosiery.

BACKGROUND

Garments of containment type, adapted to exert a containing function on the part of a user's body on which they are worn and particularly on the foot joint or other joints, are well known. Specifically, garments having orthopedic or containment functions, to be worn at the foot joints, such as stretch ankle support and the like, or to be worn on a knee, elbow, wrist or shoulder, are known. Such garments may have stretch portions shaped and structured so as to keep in the correct position the joint on which they are worn, thus preventing incorrect movements that could cause traumas. Such garments can be worn both as a preventive measure and following trauma that have compromised the tightness, especially lateral, of the joint.

As for the foot, elastic socks, with or without a portion adapted to accommodate the user's toes, or ankle bands are also used.

It is also known the so called proprioception, which is the ability to sense and recognize the position of the body and limbs in space without the support of sight, both while maintaining static postures and during movement. It is a complex neuro-physiological mechanism activated by specific receptors, which are actual sensory organs, found in muscle, on joints and skin, which send their own signals to particular areas of the brain. These sensory signals are named proprioceptive.

Particularly when running, the proprioceptive system is continuously activated and allows the movement to be performed. This applies to the technical gesture characteristic of each sport, such as the foot placement in running, the jump in volleyball, the quick change of direction in basketball, tennis and soccer, the flexion-extension during uphill and downhill hiking or walking on the green by golf players.

Those with problems in the proprioceptive system, as a result of joint traumas or degenerative diseases of the nervous system, may have uncertain movement, thus increasing the risks of falls and accidents.

Therefore, proprioceptive training and stimulation are of paramount importance for trauma prevention for all individuals playing sports, as it provides better control of muscle activity, greater joint stability, greater resistance to microtraumas, a greater sense of balance and absolute control of the technical gesture.

In particular, artistic gymnastics athletes during training subject their feet to heavy pressures and stresses caused by jumps, wide flexions, metatarsal overloads, abrupt accelerations and changes of direction, and decelerations in falls. As a result, the whole foot structure suffers and thus tends to create inflammation of the Achilles tendon, Achilles tendinitis, metatarsalgia or flattening of the foot arch.

In gymnastics as well as in other sports, the knee, elbow, wrist and shoulder joints are also particularly stressed, leading to potential consequences of traumas or inflammation of tendons and ligaments.

Therefore, it would be desirable to provide garments able to stimulate proprioceptors, so as to improve motor control thereof and prevent injuries, with the countless benefits that would follow.

Document US 2021/156058 A1 relates to a knitted containment garment, such as a stretch ankle support, a sock with ankle support, a stretch kneepad and the like, comprising at least one containment portion.

U.S. Patent Application US 2012/284902 A1 refers to socks equipped with a figure-of-eight portion that supports the ankle joint of the wearer.

Document US 2018/051401 A1 concerns a clothing item with elastic inserts, manufactured on circular machines.

International Patent Application WO 2019/104263 A1 relates to a kneepad that includes regions formed by a textile support that are arranged in combination with straps.

Finally, document US 2012/283610 A1 concerns a supporting element for the hand joint for reducing the load on the hand joints, which includes a first anchoring section to cling the user's forearm comprising a tubular knit fabric, a second anchoring section to cling the palm and back of the user's hand, and a perforated anchoring section formed as a through-hole, near the second anchoring section.

The present invention is designed with the object of overcoming the drawbacks of the known art by proposing a knitted garment having containment effect, thus suitable to give support to the joint at which it is worn, particularly to support the ankle, heel and Achilles tendon, or the knee, elbow, wrist or shoulder of the user in order to prevent or reduce inflammation, such as Achilles tendinitis, tendonitis or ligament inflammation and traumas.

Another object is to provide a tubular knit garment assembled substantially without seams, adapted to be worn at the foot and ankle, knee, elbow, wrist or shoulder of a user in order to contain and restrict his or her movements while keeping the joint itself in the correct position.

Yet another object is to provide a garment that can stimulate proprioceptors.

A further object is to provide a garment in the form of a sock or stocking, with or without a portion adapted to contain the toes, which is particularly comfortable due to the absence of seams except possibly that for the closure of its toe.

A further additional object is to provide a garment in the form of a kneepad, elbow pad, wrist brace or shoulder containment band that, being seamless, is particularly comfortable.

SUMMARY

These objects are achieved by a knitted garment according to the appended claims, which has at least one stretch portion, comprising stretch stitches obtained by knitting at least one ground yarn and one elastic yarn. According to the invention, the stretch portion has at least one containment portion comprising stitches obtained by also knitting a containment yarn alternately with at least one main yarn, so that floating lengths of the main yarn are formed at the stitches comprising the containment yarn, and vice versa, wherein such a containment portion extends at least at the part of the containment garment to be worn at the user's joint and in particular at the heel, kneecap, back of the elbow, which protrudes when the arm is being flexed, upper part of the wrist, which protrudes when the wrist is in palmar flexion, or the shoulder of the user.

Advantageously, in some embodiments, the containment portion is not extended at a first intermediate half-portion to be worn on the user's foot instep at the foot joint, the back of the knee, the inner part of the elbow or at the user's armpit, so as to allow normal full mobility of the joint itself; in this case, the first intermediate half-portion is advantageously obtained by a drop-needle knitting that makes it thin, thus preventing the formation of creases during movement.

Preferably, in the case of a containment garment to be worn on the user's wrist, the containment portion also extends at the first intermediate half-portion to be worn on the front of the wrist in order to provide support to the joint in both dorsiflexion and palmar flexion.

Preferably, to increase the containment effect, the second intermediate half-portion is not shaped as a pouch to accommodate the heel or joint combined therewith; this gives the containment garment a substantially tubular shape, possibly closed at one end thereof so as to define a toe portion intended to contain the user's toes. This way, an even stronger containment is exerted by the containment portion on the heel, that must deform the knit in order to be held in the containment garment, and generally on the respective joint that must deform the knit in order to be flexed.

Advantageously, the stretch portion extends at the entire containment garment, preferably excluding the toe portion if present in the case of a sock.

Advantageously, at least part of the containment portion is obtained by knitting the main yarn and the first containment yarn according to a so-called 2:2 selection, in which two stitches of the main yarn are followed by two stitches of the first containment yarn and so on, and a floating yarn length of the first containment yarn is formed at two stitches of the main yarn, while a floating yarn length of the main yarn is formed at two stitches of the first containment yarn.

In a particularly preferred solution, the containment garment comprises a double-containment portion, which extends at least at part of the stretch portion and is obtained by knitting a second containment yarn as well, so that a group of one or more stitches of the main yarn is followed by a group of one or more stitches of the first containment yarn, in turn followed by one or more stitches of the main yarn followed by a group of one or more stitches of the second containment yarn, and so on, correspondingly obtaining floating lengths of the first containment yarn and the second containment yarn at the groups of one or more stitches of the main yarn, floating lengths of the main yarn and the second containment yarn at the groups of one or more stitches of the first containment yarn, and floating lengths of the main yarn and the first containment yarn at the groups of one or more stitches of the second containment yarn.

Advantageously, the double-containment portion surrounds the joint the garment is combined with and any respective circular band that surrounds a limb portion adjoining the corresponding joint, particularly the user's heel and the region of the arch of the foot and the corresponding part of the instep of the foot in the case of a sock, or the user's kneecap, elbow, wrist or shoulder; preferably the double-containment portion also extends at the supporting region of the heel, the knee or the elbow.

Preferably, at least part of the stitches of some of the courses of the double-containment portion are terry knitted stitches of the first or second containment yarn or of an additional yarn, so as to make reinforcing portions in specific regions of the containment garment.

Preferably, the containing knit of the containment and/or double-containment portions is made almost entirely in the single jersey mode, except for any terry knitted stitches that may be present in the double-containment portion.

The invention also relates to a method according to claim 9 for manufacturing a knitted containment garment by means of a circular knitwear and hosiery machine. Specifically, the method provides for knitting at least one ground yarn to build a plurality of consecutive courses; knitting also an elastic yarn at some courses to build stretch stitches comprising the elastic yarn that are alternated with stitches in which the elastic yarn is not knitted; knitting a main yarn and at least one first containment yarn alternately with each other, at least at part of a plurality of successive courses of the stretch portion, to build a containment portion, wherein the main yarn and at least the first containment yarn are knitted alternately with each other at least at a second intermediate half-portion of the containment manufactured article to be worn at the heel or a joint of the user.

Preferably, the containment portion does not extend at a first intermediate half-portion to be worn on the instep of the foot, at the front of the foot joint, at the back of the knee, at the front of the elbow and at the armpit, which is instead drop-needle knitted.

Preferably, in the case of a containment garment in the form of a wrist brace, the containment portion also extends at the first intermediate half-portion.

Advantageously, no steps to build a pouch-shaped protuberance at the second intermediate half-portion normally provided to accommodate the user's heel or joint, are provided.

Advantageously, at least the first containment yarn and at least one second containment yarn are knitted alternately with the main yarn, so that stitches of the main yarn are followed by stitches of the first containment yarn, followed by stitches of the main yarn, followed by stitches of the second containment yarn and so on.

Next to at least one course, the method provides for forming terry knitted stitches of the first or second containment yarn, in order to make reinforced containment regions.

The method can advantageously provide the steps required to form a toe portion, to form one or two stretch edges and the possible step of sewing the toe portion of the containment garment.

BRIEF DESCRIPTION OF THE DRAWINGS

However, the invention will be further illustrated in the following description made with reference to the attached illustrative and non-limiting drawings, in which:

FIG. 16*b*' shows a side view of a portion of the course shown in FIG. 16*b* under a different condition of use.

DETAILED DESCRIPTION OF THE PREFERRED EMBODIMENTS

Figure 1:
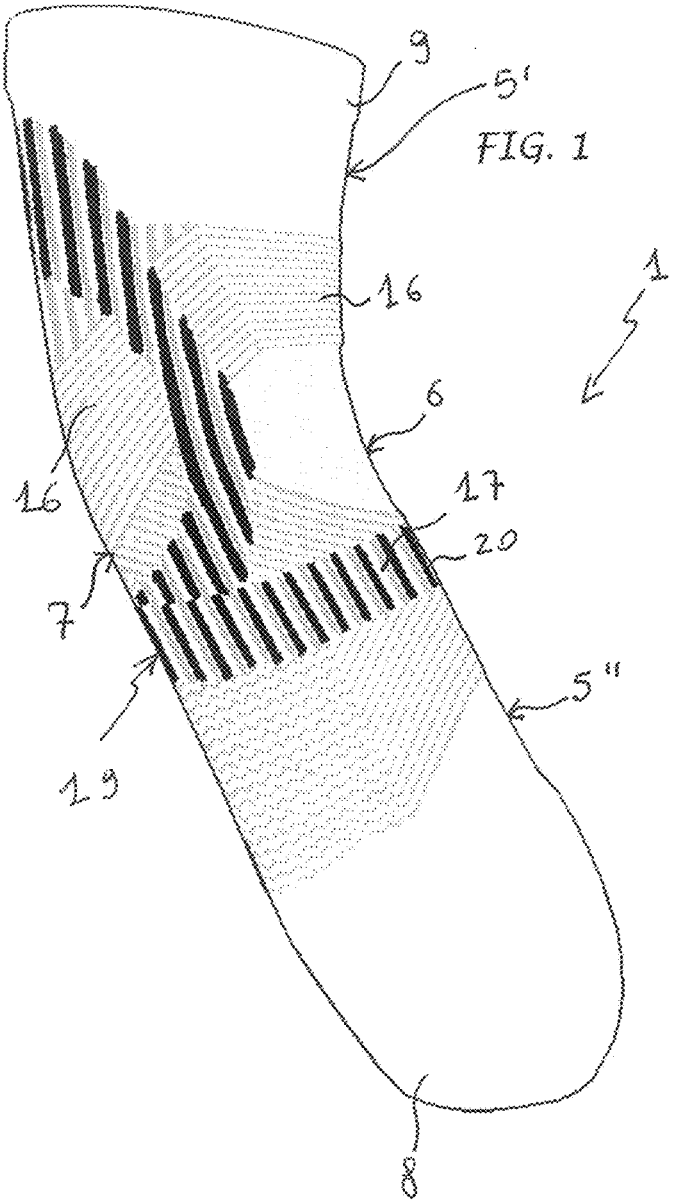
FIG. 1 is a side view of a containment garment according to the present invention.
Figure 1A:
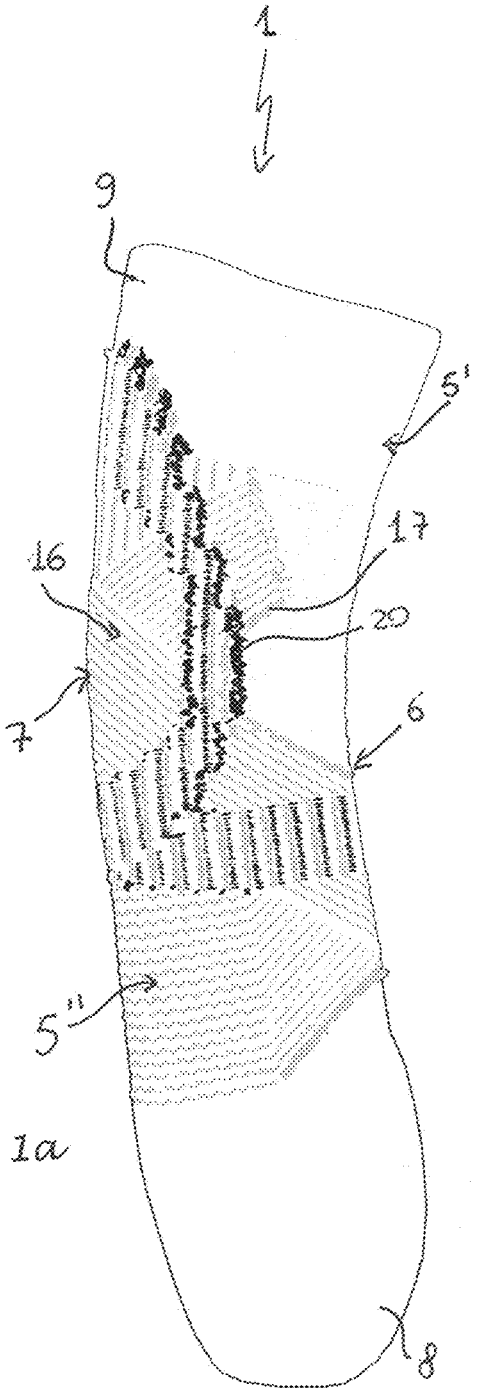
FIG. 1*a* shows a view of the inner surface of the containment garment of FIG. 1.

Various exemplary embodiments of a knitted containment garment according to the present invention are shown in the figures. Specifically, a containment garment in the form of a sock is denoted by 1, a tubular containment garment which, depending on the diameter and size, can be a toe-less sock, a kneepad, an elbow pad or a containment band for a shoulder is denoted by 2, a containment garment in the form of a wrist brace is denoted by 3 and a containment garment in the form of a sock with heel reinforcement is denoted by 4.

Specifically, the knitted containment garment 1, 2, 3, 4 comprises an upper part 5' and a lower part 5" joined together by a first intermediate half-portion 6 and a second intermediate half-portion 7. Specifically, the second intermediate half-portion is intended to be worn at the heel of the user or the kneecap, elbow, back of the wrist or on the user's shoulder, whereas the first intermediate half-portion is intended to be worn on the instep of the foot, the back of the knee, the inside of the elbow, the front of the wrist or the armpit of the user, so as to be on the opposite side with respect to the second intermediate half-portion.

The containment garment 1, 4 may also comprise a toe portion 8 to accommodate the user's toes.

In addition, the containment garment may be provided with a stretch edge 9 at one or both of its ends, i.e. only one in the case of a garment in the form of a sock, to keep the garment properly fitted.

The knitted containment garment is substantially tubular and comprises a plurality of courses obtained by knitting together at least one ground yarn 10 and at least one main yarn 11, and at least one stretch portion 12 which extends next to at least one plurality of courses R1, R2, . . . , Rn, which are obtained by knitting together at least the ground yarn 10 and at least one elastic yarn 13, preferably also the main yarn 11, or by knitting the elastic yarn in a so called drop-needle knitting, in which the elastic yarn is knitted with at least the ground yarn in some stitches referred to as stretch stitches 14, while in other stitches, referred to as float stitches 15, the ground yarn is not knitted, thereby forming lengths of elastic yarn that remain floating, as shown for example in FIGS. 16*a*-16*e*.

Preferably, the same sequence of stitches is repeated at each successive course R1, R2, . . . , Rn so that the stretch stitches and the float stitches of a course are aligned with those of the previous and next courses, so as to form columns.

In a preferred solution shown in the figures, in each course an elastic stitch alternates with a float stitch, with a so-defined 1:1 selection.

Figure 16A:
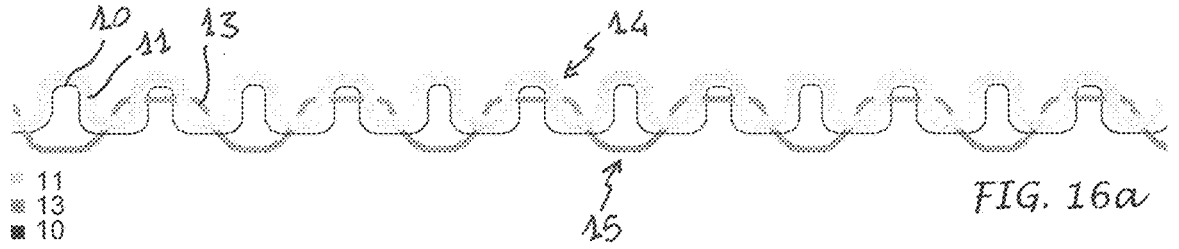
FIGS. 16*a*, 16*b*, 16*c*, 16*d*, and 16*e* each show a side view of a portion of a course of five different types of the knit fabric of the containment garments according to the present invention.

Specifically, FIG. 16*a* shows a portion of a course of the stretch portion with a 1:1 selection.

Figure 16B:
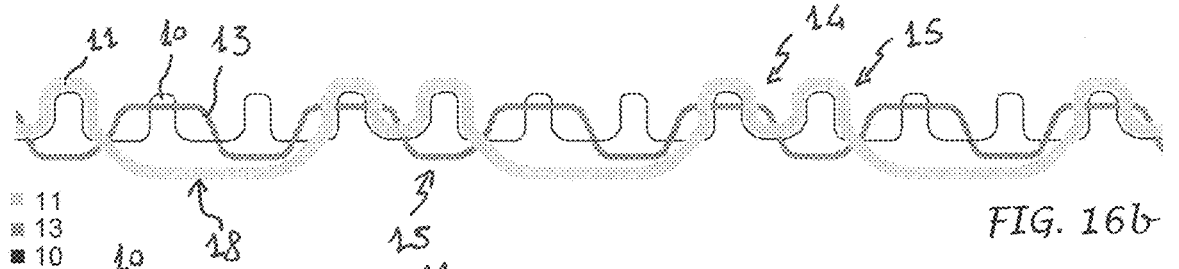
Figure 16B:
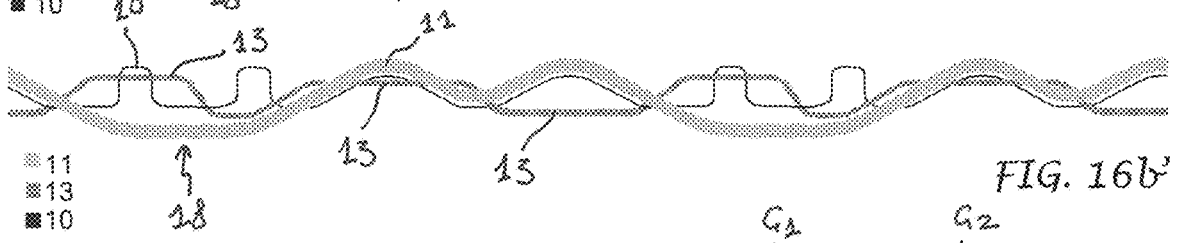

FIG. 16*b* shows part of a course with so-called drop-needle knitting, the elastic yarn 13 being knitted according to a 1:1 selection and the main yarn 11 being drop-needle knitted, so that the first stitches P1 of the main yarn are alternated with float stitches of the main yarn, which define a length of floating yarn.

Preferably, the stretch portion 12 extends at the entire garment, possibly except for the toe portion 8.

The containment garment is preferably formed in one piece, that is, it is seamless, except for any finishing seams or seams to close the toe portion, and can be made with different diameters and sizes depending on the limb portion on which it is intended to be worn, which may be a foot, knee, elbow, wrist or shoulder.

According to the invention, at least at a part of the stretch portion a containment portion 16 is also obtained by knitting the main yarn 11 and at least one first containment yarn 17, as shown in FIGS. 15, 15*a*, 16*c*, 16*d* and 16*e*. In such a portion, the main yarn 11 and the first containment yarn 17 are knitted alternately with respect to each other, so that a floating yarn length 18' of the first containment yarn 17 is formed at first groups G1 of one or more first stitches P1 of the main yarn 11, and vice versa a floating yarn length 18 of the main yarn 11 is formed at second groups $G_2$ of one or more second stitches $P_2$ of the first containment yarn 17.

The main yarn and the first containment yarn each form a respective sequence of stitches, comprising at least one plain-knit stitch followed by at least one float stitch. The term "plain-knit stitch" means a stitch in which the yarn is knitted with the corresponding stitch of the previous course, whereas "float stitch" means a stitch in which the yarn is not knitted with the corresponding stitch of the previous course, resulting in a floating yarn length 18, 18' that extends between two successive stitches of the same yarn and is visible from an inner side of the knit fabric, referred to as reverse side.

Figure 16C:
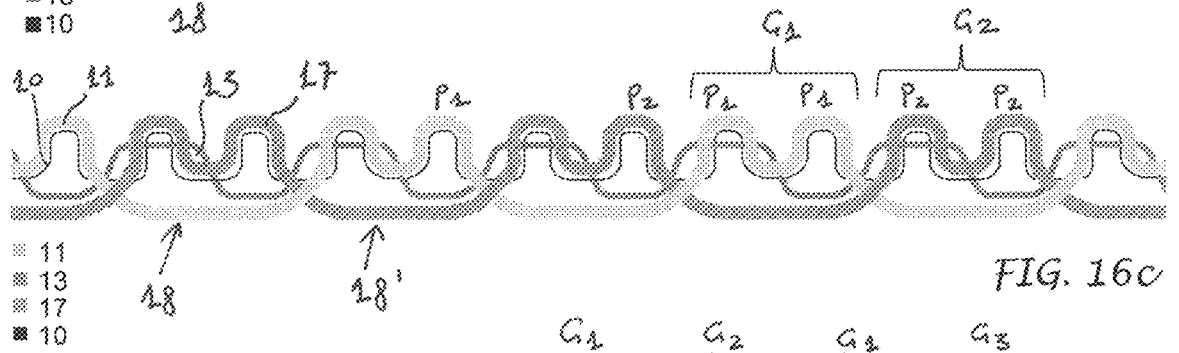

Preferably, at least part of the containment portion is obtained by knitting the main yarn and the first containment yarn so that two stitches P1 of the main yarn are followed by two stitches P2 of the first containment yarn, and so on, and a floating yarn length 18' of the first containment yarn is formed at two stitches P1 of the main yarn, whereas a floating yarn length 18 of the main yarn is formed at two stitches $P_2$ of the first containment yarn. In other words, the stitches and the float stitches of the main yarn and of first containment yarn are alternated according to a 2:2 selection, as shown in FIG. 16*c*.

The float stitches of the main yarn and of the first containment yarn are less extensible than the plain-knit stitches, therefore they reduce the extensibility of the stretch portion thus increasing the thickness and stiffness thereof to give the desired containment effect. At the same time, the use of the elastic yarn 13 and a preferably elastic ground yarn 10, made of polyurethane synthetic fiber such as spandex or elastam, gives elasticity to the fabric, which therefore becomes compressive and containing. By alternating stitches and float stitches in a different way, according to other selections, such as 1:1, 1:3, 2:2, 2:1, 2:4, etc., fabrics having different containment capacity and strength can be obtained. The type of selection can vary from one course to another or even within the same course.

In fact, as can be seen in FIG. 16*b*' which shows part of the course in FIG. 16*b* in a condition of use, when the knit is stretched because it is worn, it can be seen that the stitches at the floating yarn length 18 of the main yarn 11 substantially maintain the same extension as when at rest, like the corresponding stitches shown in FIG. 16*b*, while the other stitches deform, elongating with respect to the corresponding stitches shown in FIG. 16*b*.

Preferably, a part of the stretch portion 12 provided with a containment portion 16 extends at least at a portion of the upper part 5', the lower part 5" and the second intermediate half-portion 7 of the containment garment, particularly in the region intended to be worn over a portion of a user's limb selected from the heel, kneecap, elbow, back of the wrist and shoulder, depending on whether the containment garment is a toe or toeless sock, a kneepad, an elbow pad, a wrist brace or a shoulder support band.

Figure 4:
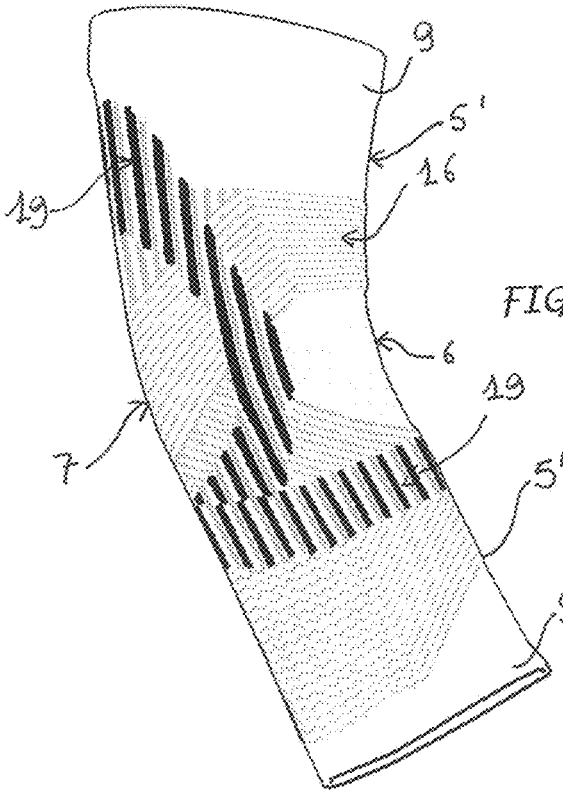
FIG. 4 shows a side view of another embodiment of a containment garment according to the present invention.

In a preferred solution, unlike traditional socks or stockings, the containment garment in the form of a sock does not comprise any pouch-shaped portion to accommodate the user's heel but has a substantially tubular shape, as visible particularly in FIGS. 1 and 4. In other words, the second intermediate half-portion 7 has no protuberance to be worn on the user's heel. Thus, when the containment garment is worn, the containment portion that extends at the second intermediate half-portion 7 exerts high pressure on the heel region to facilitate the propulsion of the foot during the technical sports gesture of jumping.

Figure 16D:
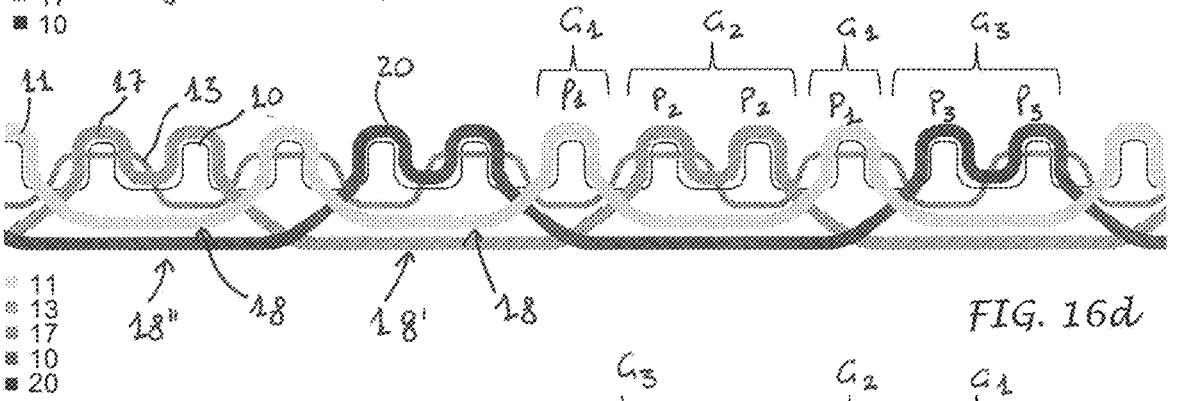
Figure 16E:
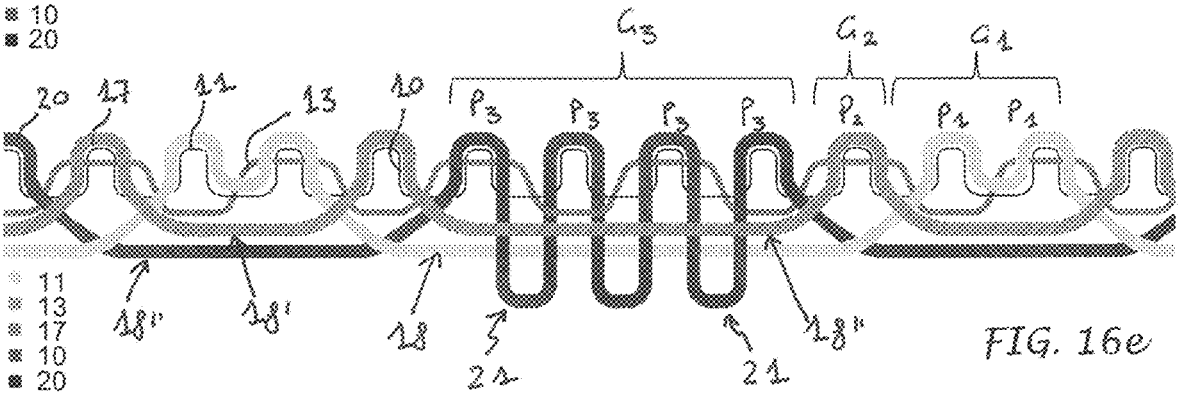

In addition, the containment garment may have a double-containment portion 19 obtained by also knitting a second containment yarn 20, so that the main yarn 11, the first containment yarn 17 and the second containment yarn are alternately knitted, so that first groups G1 of one or more first stitches P1 of the main yarn 11 are followed alternately by second groups G2 of one or more second stitches P2 of the first containment yarn 17 or third groups G3 of one or more third stitches P3 of the second containment yarn 20, as shown in FIGS. 16*d* and 16*e*. As a result, floating yarn lengths 18' of the first containment yarn 17 and floating yarn lengths 18" of the second containment yarn 20 are formed at the first groups G1 of one or more first stitches $P_1$ of the main yarn 11, floating yarn lengths 18 of the main yarn 11 and floating yarn lengths 18" of the second containment yarn 20 are formed at second groups $G_2$ of one or more second stitches $P_2$ of the first containment yarn 17 and floating yarn lengths 18 of the main yarn 11 and floating yarn lengths 18' of the first containment yarn 17 are formed at third groups $G_3$ of one or more third stitches $P_3$ of the second containment yarn 20.

Figure 12A:
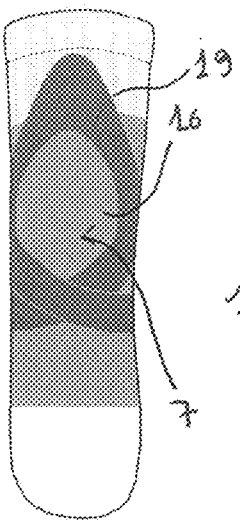
FIGS. 12*a*, 12*b* and 12*c* show schematic rear, side and front views of the garment in FIG. 1, in which differently-knitted regions are depicted with different shades of gray.
Figure 12B:
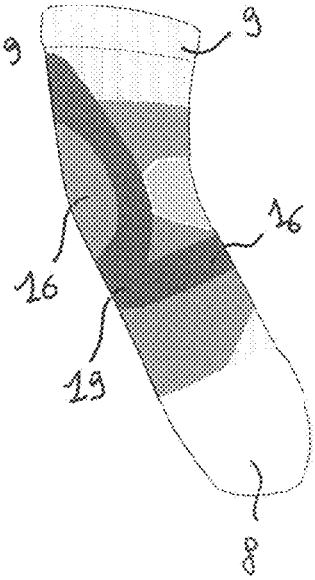
Figure 12C:
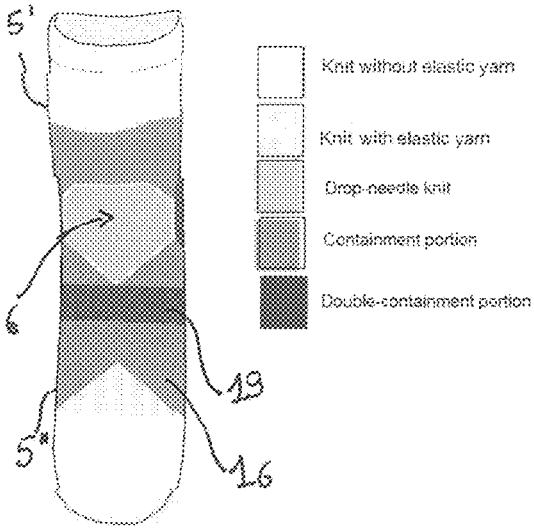
Figure 13A:
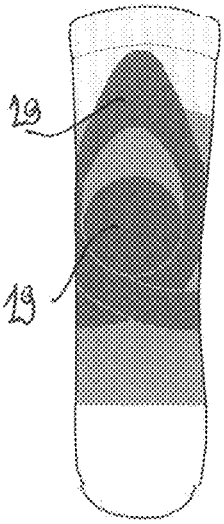
FIGS. 13*a*, 13*b* and 13*c* show schematic rear, side and front views of the garment in FIG. 10, in which differently-knitted regions are depicted with different shades of gray.
Figure 13B:
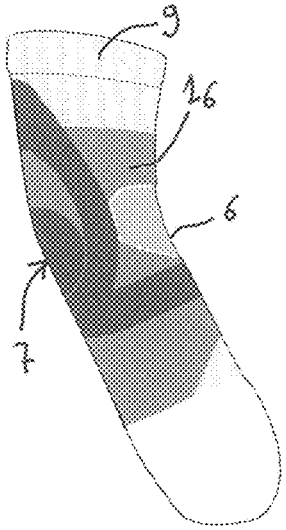
Figure 13C:
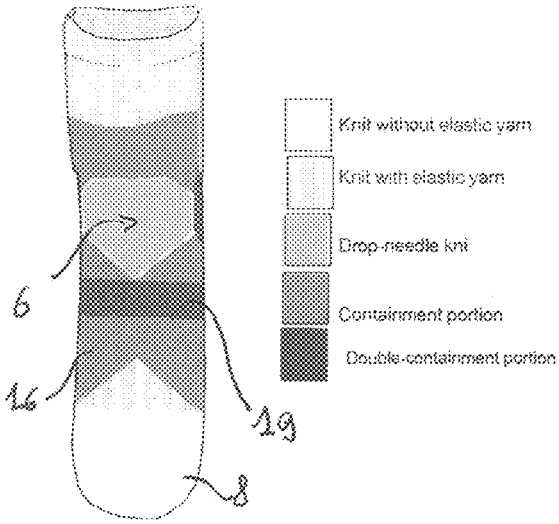
Figure 14:
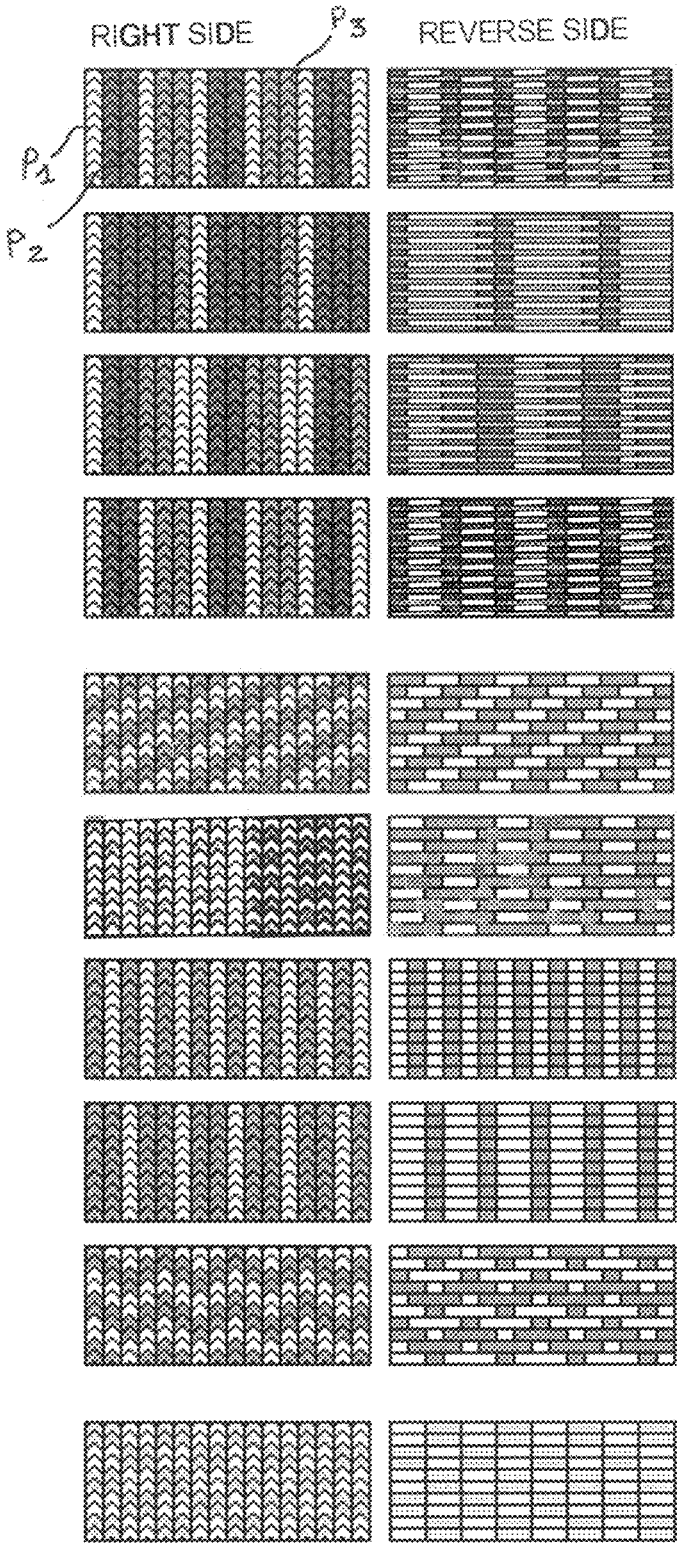
FIG. 14 schematically shows the stitches differently knitted of the containment garments according to the present invention, viewed from both the right side and the reverse side.
Figure 15:
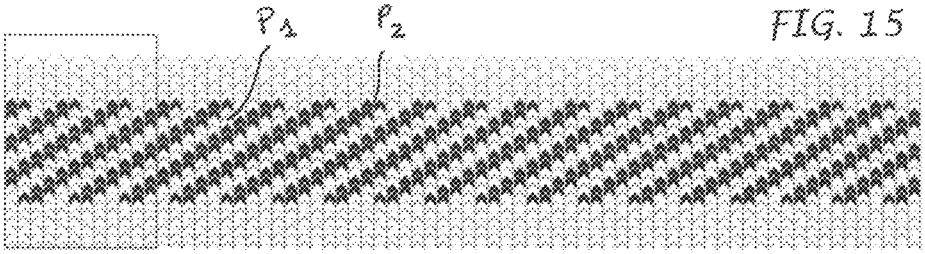
FIG. 15 schematically shows a portion of a knit fabric of the containment garments according to the present invention.
Figure 15A:
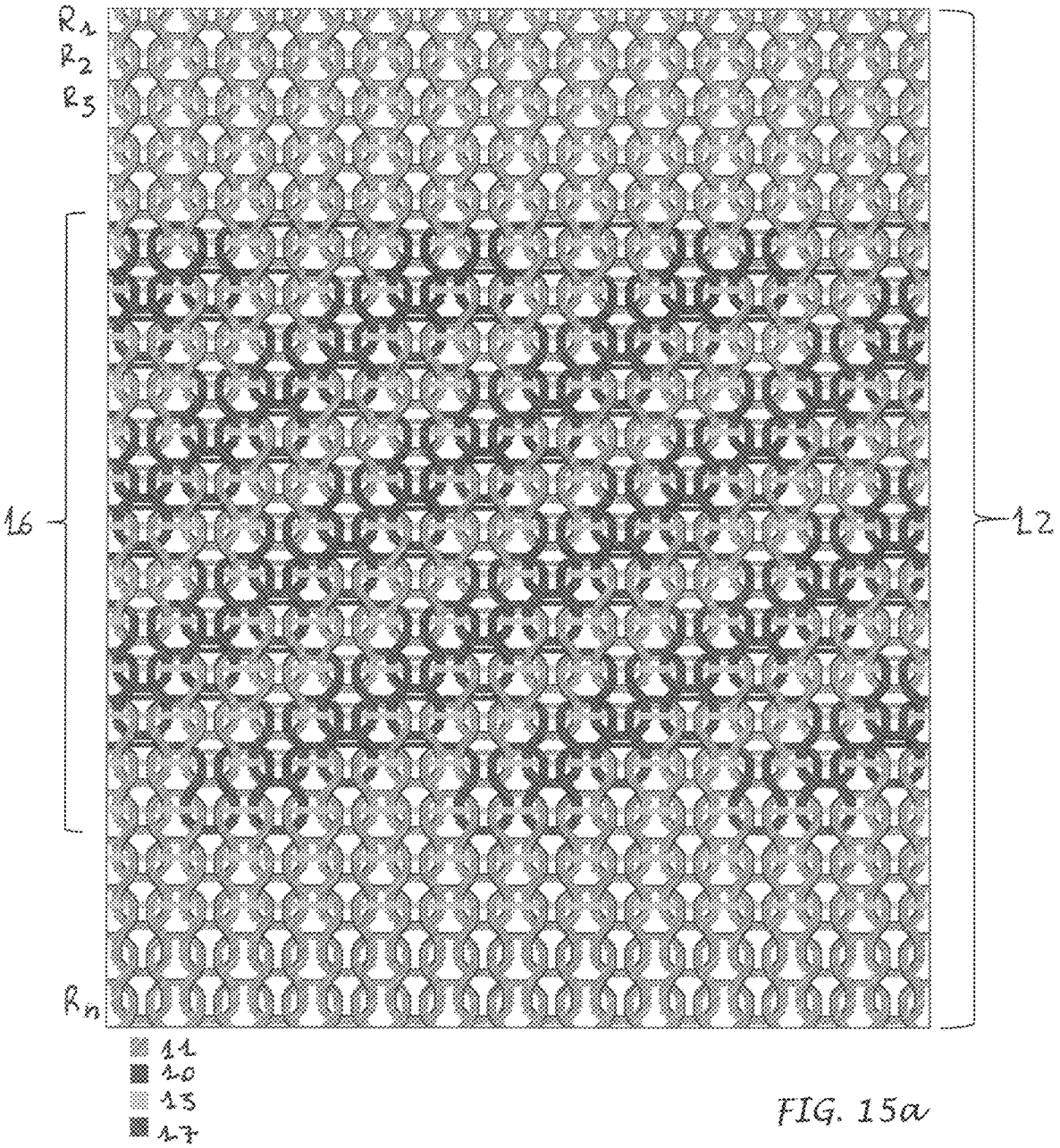
FIG. 15*a* shows a diagram of the stitches of a portion of knit fabric of the restraining garments according to the present invention.

When the garment is worn, the double-containment portion 19 preferably extends so as to surround the user's heel and in the region intended to surround at least the arch of the foot and the corresponding part of the instep of the foot, as shown particularly in FIGS. 12*a*, 12*b*, and 12*c*, to give more support to the Achilles tendon during the flexion of the foot.

In the containment garment 4 in the form of a sock with reinforcement, the double-containment portion 19 also extends at the supporting region of the user's heel, as shown particularly in FIGS. 10, 11, 13*a*, and 13*b*, so as to increase the pressure on the heel's region in order to promote foot extension and further improve the propulsion in the technical sports gesture of jumping.

Advantageously, regions having differentiated containment can be obtained by both plain and terry knitting. Specifically, in a particularly preferred solution shown in FIG. 16*e*, the double-containment portion may have terry knitted stitches 21 of the first or second containment yarn, at least at part of some of the courses, to make reinforcement and protection regions of certain parts of the foot, for example the malleoli, or kneecap or elbow.

Since there are floating yarn lengths of the main yarn and the second or first containment yarn at these terry knitted stitches, the knit cannot be extended thus maintaining its containment function, but is thicker due to the presence of the terry knitted stitches. Therefore, the double-containment portion can define malleolar and/or heel-level padding, which act as shock absorbers for the impact at the end of the jump so as to provide greater protection and comfort to the user, or at the kneecap or elbow level, to increase comfort when resting on the ground, for example on all fours position.

Alternatively, terry knitted stitches can be built by means of a further yarn—not shown—additional with respect to the main yarn, the first containment yarn and the second containment yarn, if any.

The containment portion and the double-containment portion, if any, can be obtained by knitting another yarn—not shown—in place of the main yarn, to be alternated with the first containment yarn 17 or the second containment yarn 20.

In addition, the containment garment could also have triple-containment portions—not shown—obtained by using a third containment yarn.

Figure 2:
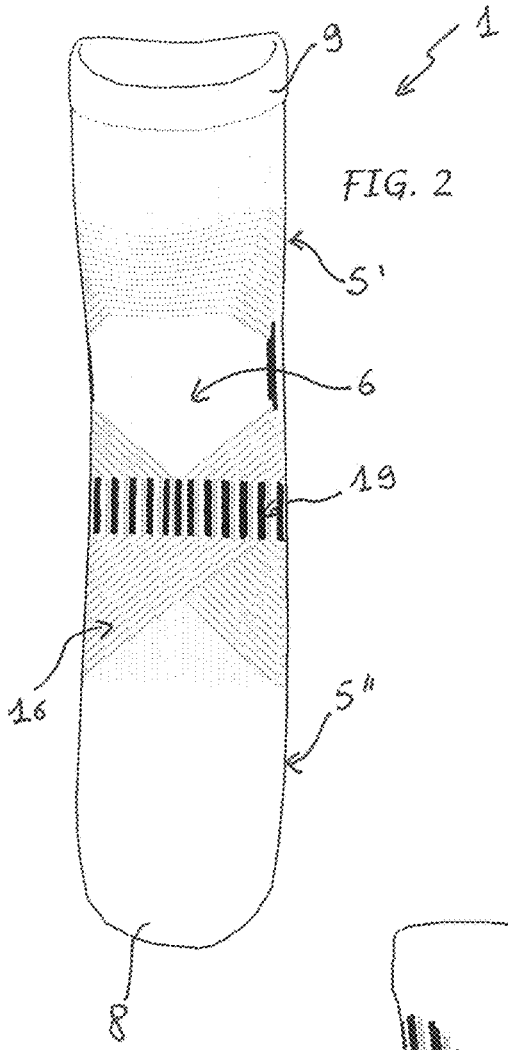
FIGS. 2 and 3 show a front and a rear view of the containment garment of FIG. 1, respectively.
Figure 3:
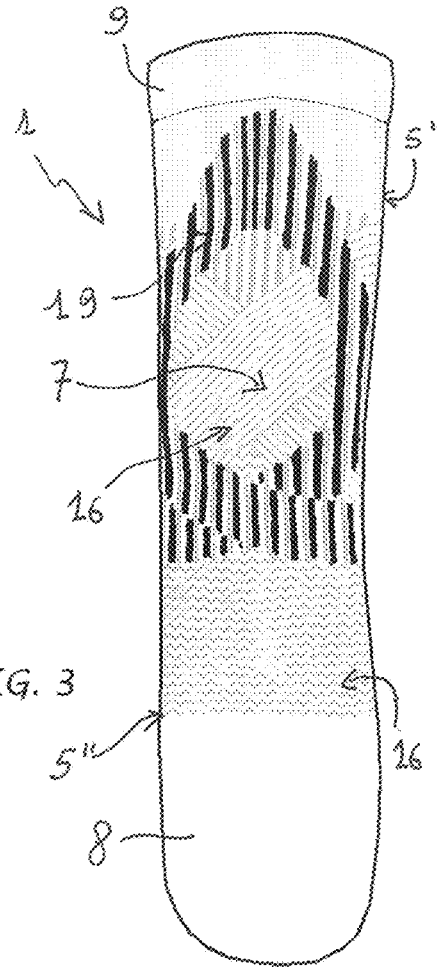

Advantageously, in the case of a containment garment 1, 2, 4 to be worn on a user's foot, knee, elbow or shoulder, the containment portion and the double-containment portion, if any, do not extend next to at least part of the first intermediate half-portion 6; in particular, at least part of the first intermediate half-portion comprises a drop-needle knitting of the type shown in FIG. 16*b*', specifically an alternate drop-needle knitting (1:1; 1:2; 1:3; 2:1; 2:2; 2:3; 3:3; . . . ), in which, to lighten the fabric, no containment yarn is knitted thus giving a slight curvature to the containment garment so as to promote flexion of the joint, to prevent the formation of fabric creases that would otherwise be caused, in the case of a sock, by the absence of the pouch to accommodate the heel. Particularly in alternate drop-needle knitting, the knitting stitches and float stitches of a course are alternated with those of the preceding and following courses, as can be seen, for example, in FIG. 2.

Figure 5:
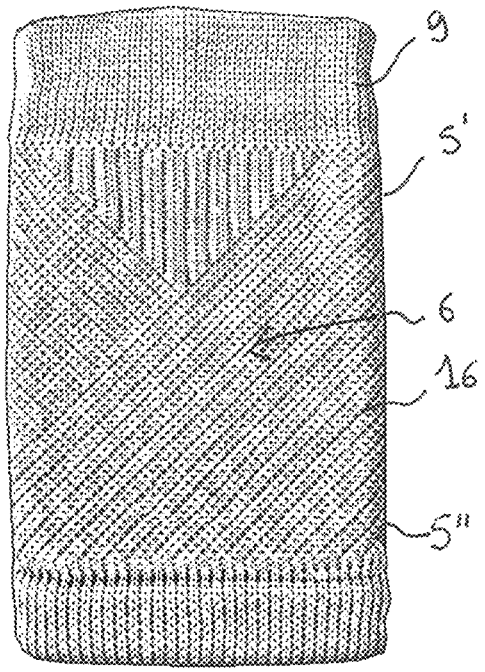
FIGS. 5 and 6 show a front view and a rear view of a further embodiment of a containment garment according to the present invention, respectively.
Figure 6:
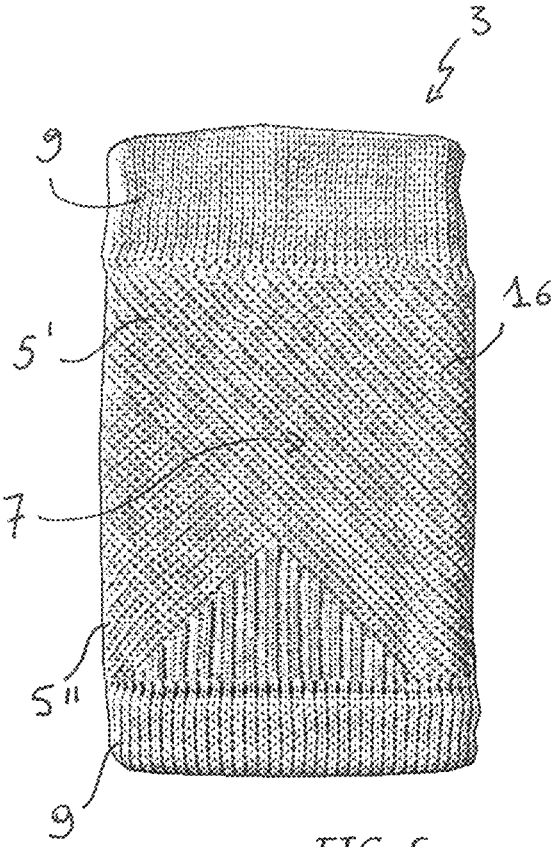
Figure 6A:
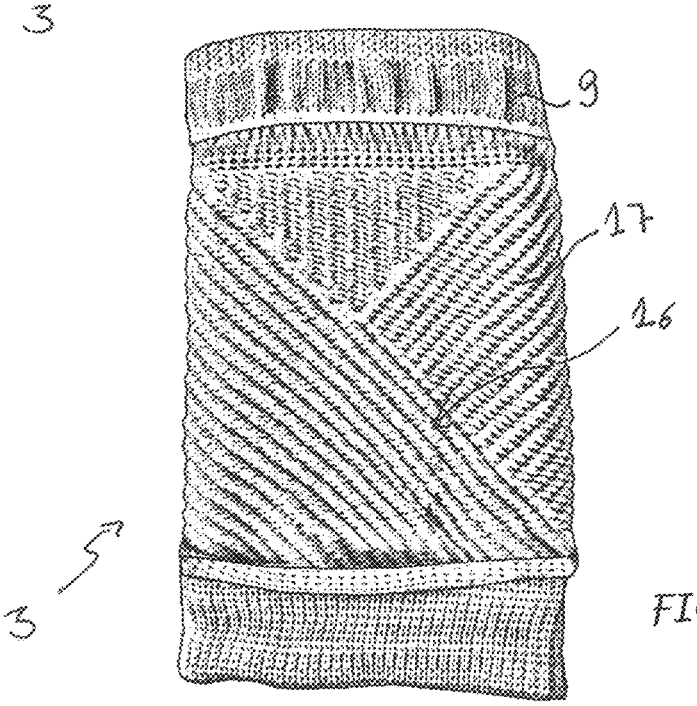
FIG. 6*a* shows a view of the inside of the containment garment of FIG. 6.
Figure 7:
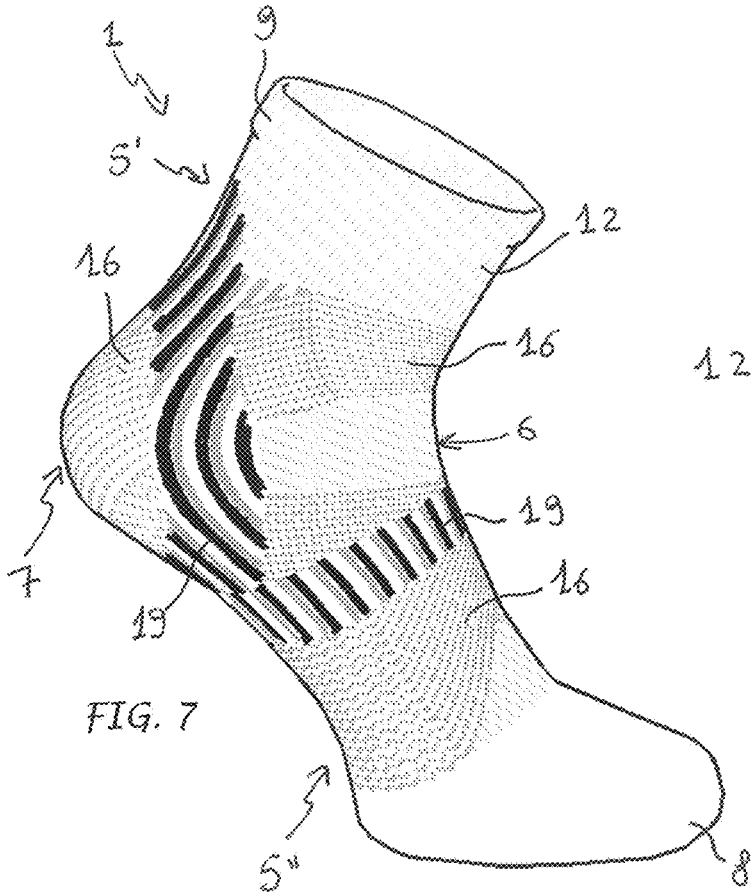
FIGS. 7, 8 and 9 show a side view, a front view and rear view of the containment garment of FIG. 1 when worn, respectively.
Figure 8:
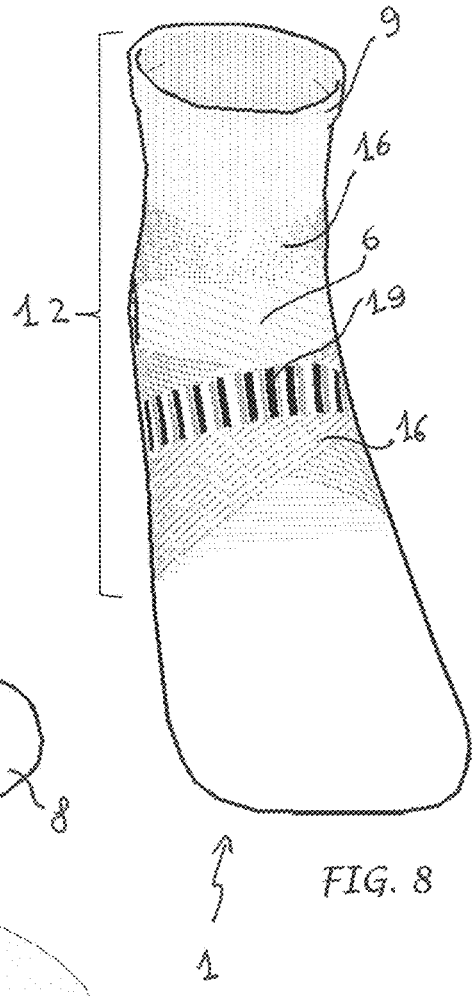
Figure 9:
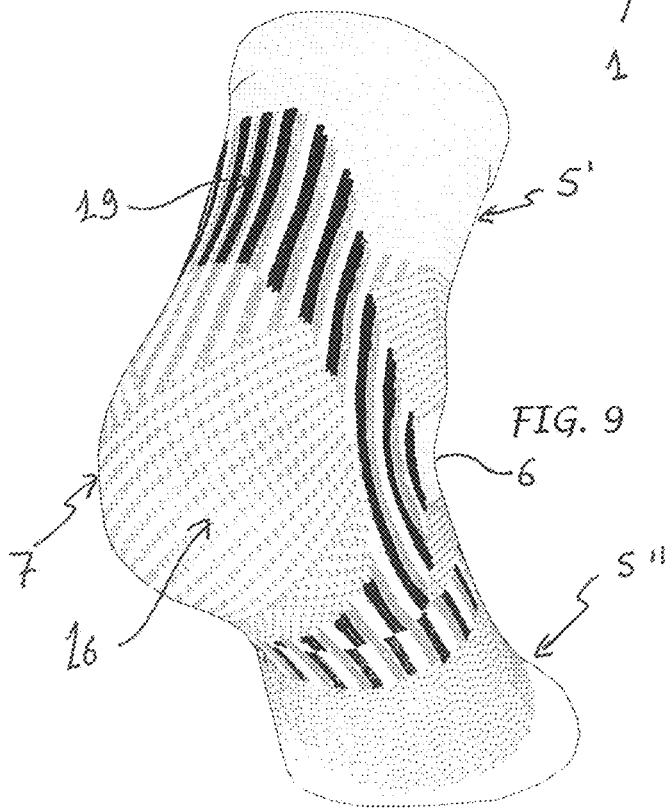
Figure 10:
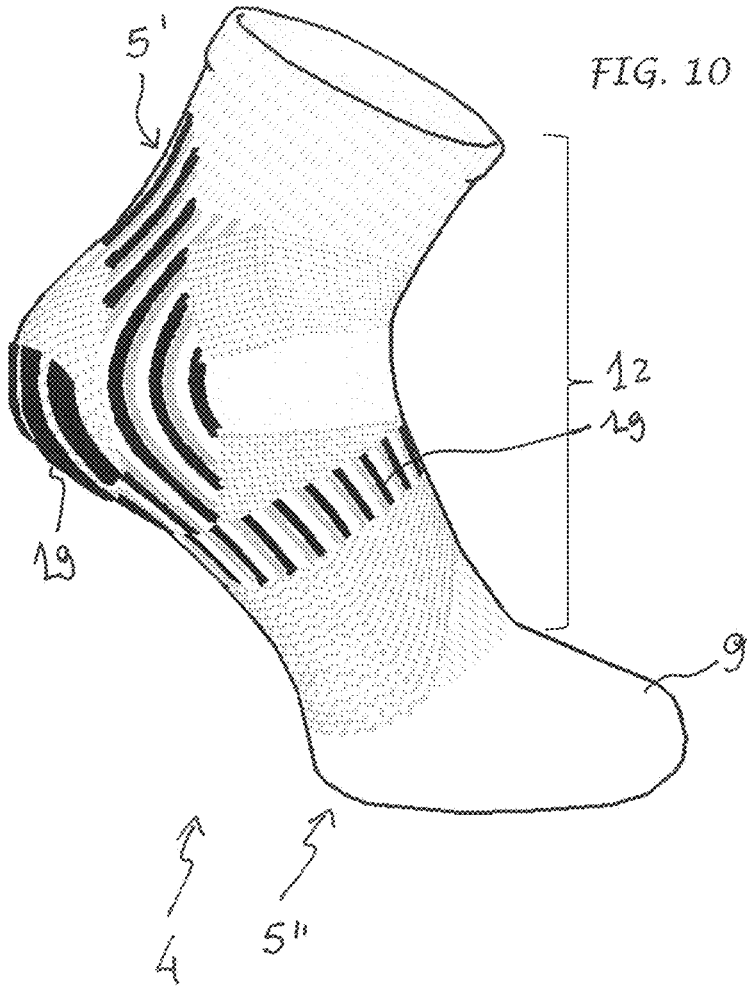
FIGS. 10 and 11 show a side view and rear view of a variation of the containment garment of FIG. 1 when worn, respectively.
Figure 11:
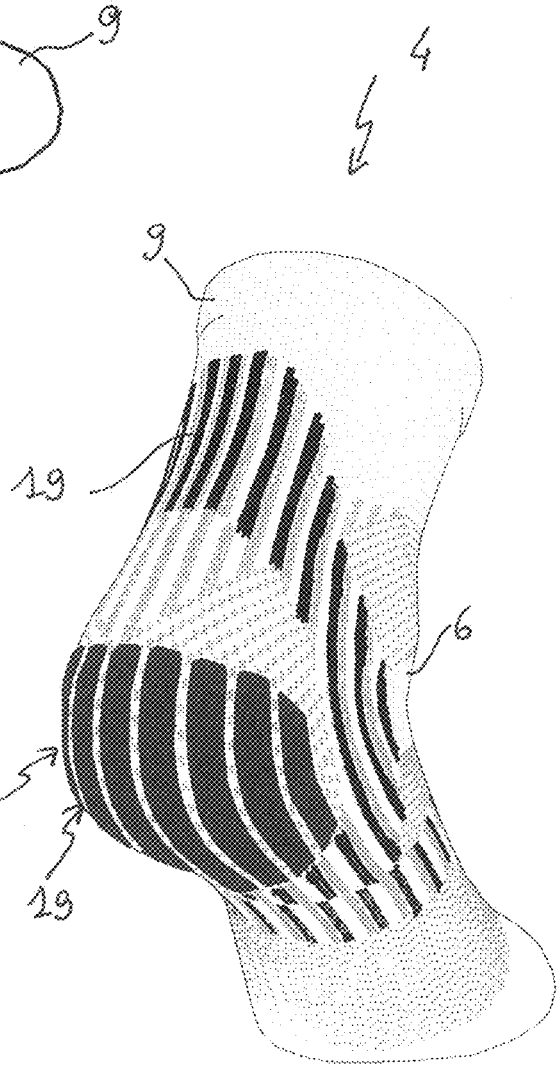

On the other hand, advantageously, in the case of a containment garment 3 in the form of a wrist brace, the containment portion and the double-containment portion, if any, also extend next to at least part of the first intermediate half-portion 6, as shown in FIG. 5, to provide support even during the dorsiflexion of the wrist.

Each containment and double-containment portion is intended to give the garment a containment effect and in particular to bear and support the ankle and heel, or knee, elbow, wrist or shoulder on which it is worn.

In detail, the containment portion comprises two bands that cross each other at least at the second intermediate half-portion and at a front part of the lower portion and join each other at a front part of the upper portion. Preferably such bands are shaped to extend at least partially inclined with respect to the transverse direction of the upper and lower parts.

Therefore, the containment portion, viewed as a whole, form a kind of spiral that wraps around the limb portion combined therewith, possibly leaving free the instep at the foot joint, or the back of the knee, the front of the elbow or the user's armpit.

The main yarn, the first and second containment yarns can have the same yarn count or be of different yarn counts, preferably the first and second containment yarns have a larger diameter, even twice as large, as the diameter of the main yarn. Actually, this allows a strong localized containment effect to be achieved in the containment portion, while the remaining part is lighter, thinner and particularly stretch in order to increase the comfort of the garment and allow it to be worn more easily.

The main yarn and the containment yarns can have different colors so as to highlight the containment portion and the double-containment portion, if any, with respect to the remaining part of the garment. In addition, the containment garment can be made by means of yarns with antibacterial and anti-odor properties.

Advantageously, the stretch portion may extend only at the courses in which there are the containment portion and the double-containment portion as well, or over a greater number of courses or even at the entire garment, possibly excluding the toe portion. Preferably, the stretch portion extends over at least 80% of the containment garment.

The containment garment according to the present invention, thanks to the containment portions and/or double-containment portions, allows to:

Stimulate the proprioceptive system

Improve balance and motor control

Prevent injuries

Cushion in the impact regions of malleoli and heel, knees or elbows

Provide greater protection and comfort.

The containment garment 1, 2, 3 or 4 is preferably made by using a circular knitwear and hosiery machine.

The method provides for building a plurality of courses obtained by knitting at least the ground yarn 10 to build a knit fabric, comprising at least one stretch portion 12 that is obtained by also knitting an elastic yarn 13, and also knitting the main yarn 11 and at least the first containment yarn 17 alternately with the main yarn, at least at part of the stretch portion, to obtain a portion of fabric referred to as containment portion 16, in which stitches, obtained by knitting the main yarn and not knitting the first containment yarn, alternate with stitches obtained by knitting the containment yarn and not knitting the main yarn. This way, floating containment-yarn lengths 18' are formed at the stitches comprising the main yarn, and floating main-yarn lengths 18' are formed at the stitches comprising the containment yarn.

In particular, the method comprises the following steps of:

a) knitting at least one ground yarn 10 to build a plurality of consecutive courses;

b) at least at some courses $R_1, R_2, \ldots, R_n$, knitting an elastic yarn 13 to build stretch stitches 14, so that groups of at least one stretch stitch are alternated with groups of stitches in which said elastic yarn is not knitted;

c) at least at one of said courses $R_1, R_2, \ldots, R_n$, knitting also the main yarn 11 and at least one first containment yarn 17 alternately with each other; and d) repeating step c) at subsequent courses, to build a containment portion 16.

This results in a stretch knit fabric that, at least in one part thereof, comprises a containment portion as well defined by a sequence of stitches, as shown in FIG. 15*c*. Shown in this figure are stitches P1 of the main yarn alternated with stitches P2 of the first containment yarn, and floating yarn lengths 18, 18' of the main yarn and the first containment yarn.

Preferably, in adjacent courses, the stitches of the main yarn and the stitches of the first containment yarn in one course, in the next one can be at least partially offset from the previous one, to build an inclined containment portion, as shown in the figures.

Preferably, the steps required to form the containment portion provide the formation of a containment portion comprising two bands at least partially inclined with respect to the direction of the courses that are connected with each other at the second intermediate half-portion.

Moreover, in the method according to the present invention, step c) may provide for knitting the main yarn 11 with at least the first containment yarn 17 and at least one second containment yarn 20 alternately with each other, next to at least one of said courses R1, R2, . . . , Rn; and step d) provides for repeating step c) at successive courses, to build the double-containment portion 19.

This results in a stretch knit fabric that, at least in one part thereof, comprises a double-containment portion as well, defined by a sequence of stitches, as shown in FIGS. 15*d*, 15*e*. These figures show stitches P1 of the main yarn, alternated with stitches P2 of the first containment yarn and with stitches $P_3$ of the second containment yarn, and floating yarn lengths 18, 18', 18" of the main yarn, the first containment yarn and the second containment yarn.

In addition, the method may provide the necessary steps to form terry knitted stitches 21 of the first or second containment yarn next to at least part of some courses of the double-containment portion, in order to make reinforced containment regions.

In the case where the containment garment 1, 3 is in the form of a sock, the method also provides the steps required to form the toe of the sock 8 and a possible step of sewing the toe portion itself, to be carried out directly on board the circular machine or by a later operation.

The method may also provide the steps, known per se, required to form one or two stretch finishing edges 9 to be combined with the end(s) of the garment.

In order to meet contingent and specific requirements, several variations and modifications may be made by a field technician to the illustrated and described embodiments of present invention, provided that all are included in the protection scope of the invention as defined by the following claims.

The invention claimed is:

1. A knitted containment garment (1, 2, 3, 4) to be worn at a user's joint selected from the group consisting of: ankle, knee, elbow, wrist, and shoulder, the knitted containment garment comprising at least one upper part (5') and a lower part (5") joined together by a first intermediate half-portion (6) and a second intermediate half-portion (7) to be worn at the user's heel, kneecap, elbow, wrist back, or shoulder, wherein said containment garment is substantially seamless and comprises at least one stretch portion (12) which extends next to at least one plurality of courses (R1, R2, . . . , Rn) and comprises a plurality of stitches of at least one ground yarn (10) and at least one elastic yarn (13), and wherein next to at least part of said at least one stretch portion (12) there is a containment portion (16), in which first groups (G1) of one or more first stitches (P1) comprising at least one main yarn (11) alternate with second groups (G2) of one or more second stitches (P2) comprising a containment yarn (17), so that a length of floating yarn (18') of said containment yarn (17) is extended at each of said first stitches (P1) and a length of floating yarn (18) of said at least one main yarn (11) is extended at each of said second stitches (P2), the knitted containment garment being characterized in that said containment portion extends next to at least one portion of said at least one upper part (5'), said lower part (5") and said second intermediate half-portion (7), so as to extend at least at the region of the containment manufactured article to be worn at the heel, kneecap, elbow, back of the wrist, or shoulder of the user.

2. The knitted containment garment (1, 2, 4) according to claim 1, wherein said containment garment is a sock with or without toe, a kneepad, an elbow pad, or shoulder support band, wherein the containment portion does not extend at the first intermediate half-portion (6) and wherein said first intermediate half-portion may comprise drop-needle knitting.

3. The knitted containment garment (3) according to claim 1, wherein said containment garment is a wristband and wherein the containment portion also extends at the first intermediate half-portion (6).

4. The knitted containment garment (1, 2, 3, 4) according to claim 1, wherein the second intermediate half-portion (7) has no pouch-shaped portion to accommodate a heel, kneecap, elbow, wrist, or shoulder of the user, wherein the containment garment has a substantially tubular shape, and wherein the at least one stretch portion (12) extends at the entire garment.

5. The knitted containment garment (1, 4) according to claim 1, further comprising a toe portion (8) to accommodate the user's toes, and wherein the at least one stretch portion (12) extends at the entire garment, except said toe portion.

6. The knitted containment garment (1, 2, 3, 4) according to claim 1, wherein next to at least part of the at least one stretch portion (12) there is a double-containment portion (19) obtained by knitting a second containment yarn (20) as well, so that first groups (G1) of one or more first stitches (P1) of the at least one main yarn (11) are alternately followed by second groups (G2) of one or more second stitches (P2) of the first containment yarn (17) or by third groups (G3) of one or more third stitches (P3) of the second containment yarn (20) and that floating yarn lengths (18') of the first containment yarn (17) and floating yarn lengths (18") of the second containment yarn (20) are formed at the first groups (G1) of one or more first stitches (P1) of the main yarn (11), floating yarn lengths (18) of the at least one main yarn (11) and floating yarn lengths (18") of the second containment yarn (20) are formed at second groups (G2) of one or more second stitches (P2) of the first containment yarn (17) and floating yarn lengths (18) of the at least one main yarn (11) and floating yarn lengths (18') of the first containment yarn (17) are formed at third groups (G3) of one or more third stitches (P3) of the second containment yarn (20).

7. The knitted containment garment (1, 2, 3, 4) according to claim 6, wherein the double-containment portion (19) extends so as to surround the heel, kneecap, elbow, back of the wrist or shoulder of the user and at least the arch of the foot and the corresponding part of the instep of the foot, in the case of the knitted garment is in the form of a sock, and wherein said double-containment portion may also extend at a supporting region of the user's heel, knee or elbow.

8. The knitted containment garment (1, 2, 3, 4) according to claim 6, wherein the double-containment portion comprises terry knitted stitches (21) of the first or second containment yarn, or of an additional yarn, said terry knitted stitches (21) extending next to at least part of some courses of the stretch portion, in order to make reinforcing regions.

9. A method of manufacturing, by means of a circular knitwear and hosiery machine, a containment garment (1, 2, 3, 4) to be worn at a user's joint selected from the group consisting of: ankle, knee, elbow, wrist and shoulder, the containment garment comprising at least one upper part (5') and one lower part (5") joined together by a first intermediate half-portion (6) and a second intermediate half-portion (7), wherein said containment garment is a tubular garment that is substantially seamless and comprises at least one stretch portion (12) extending next to at least one plurality of courses (R1, R2, . . . , Rn) of the containment garment and obtained by knitting at least one ground yarn (10) and at least one elastic yarn (13), and at least one containment portion (16) next to at least part of said at least one stretch portion, wherein said containment portion is obtained by also knitting a main yarn (11) and a first containment yarn (17) alternately with each other so that first groups (G1) of one or more first stitches (P1) comprising the main yarn, alternating with second groups (G2) of one or more second stitches (P2) comprising the containment yarn, are formed, and that floating lengths (18') of the containment yarn are extended at the stitches containing the main yarn, and vice versa, floating lengths (18) of the main yarn are extended at the stitches containing the containment yarn, wherein, the method comprises the steps of:

a) knitting at least one ground yarn (10) to build a plurality of consecutive courses;

b) knitting, at least at some courses (R1, R2, . . . , Rn), an elastic yarn (13) to build stretch stitches (14), so that groups of at least one stretch stitch are alternated with groups of stitches in which said elastic yarn is not knitted;

c) knitting, at least at part of one of said courses (R1, R2, . . . , Rn), a main yarn (11) and at least one first containment yarn (17) alternately with each other; and d) repeating step c) at subsequent courses, to build a containment portion (16), wherein step c) is carried out at least at said second intermediate half-portion (7) to make a containment portion (16) that extends at least at the region of the containment manufactured article to be worn on a heel, kneecap, elbow, back of the wrist or shoulder of the user.

10. The method of manufacturing a knitted containment garment (1, 2, 4) according to claim 9, wherein step c) is not carried out at said first intermediate half-portion (6).

11. The method of manufacturing a knitted containment garment (1, 2, 3, 4) according to claim 9, wherein no step is provided to build a pouch at the second intermediate half-portion (7).

12. The method of manufacturing a knitted containment garment (1, 2, 3, 4) according to claim 9, wherein step c), next to at least one of said courses (R1, R2, . . . , Rn), comprises knitting the main yarn (11) with at least one first containment yarn (17) and at least one second containment yarn (20) alternately with each other; and step d) provides for repeating step c) at successive courses, to build a double-containment portion (19).

13. The method of manufacturing a knitted containment garment (1, 2, 3, 4) according to claim 12, wherein step c), next to at least one of said courses (R1, R2, . . . , Rn), comprises knitting said first or second containment yarn so as to form terry knitted stitches (21) of said first or second containment yarn, next to at least part of said some courses of said double-containment portion, to make reinforcing containment regions.

14. The method of manufacturing a knitted containment garment (1, 2, 3) according to claim 9, further comprising forming one or two stretch finishing edges (9) to be combined with at least one end of the garment and/or for building a toe portion (8) of the containment garment (1, 4).

* * * * *